US011155762B2

(12) United States Patent
Sumant et al.

(10) Patent No.: US 11,155,762 B2
(45) Date of Patent: Oct. 26, 2021

(54) SUPERLUBRIOUS HIGH TEMPERATURE COATINGS

(71) Applicant: UCHICAGO ARGONNE, LLC, Chicago, IL (US)

(72) Inventors: Anirudha V. Sumant, Plainfield, IL (US); Venkata Aditya Ayyagari, Darien, IL (US)

(73) Assignee: UChicago Argonne, LLC, Chicago, IL (US)

( * ) Notice: Subject to any disclaimer, the term of this patent is extended or adjusted under 35 U.S.C. 154(b) by 0 days.

(21) Appl. No.: 16/587,438

(22) Filed: Sep. 30, 2019

(65) Prior Publication Data

US 2021/0095218 A1 Apr. 1, 2021

(51) Int. Cl.

| | |
|---|---|
| ***C10M 103/00*** | (2006.01) |
| ***C10M 103/06*** | (2006.01) |
| ***C10M 103/02*** | (2006.01) |
| ***C10M 177/00*** | (2006.01) |
| *C10N 30/06* | (2006.01) |
| *C10N 50/08* | (2006.01) |

(52) U.S. Cl.

CPC ..... *C10M 103/06* (2013.01); *C10M 103/02* (2013.01); *C10M 177/00* (2013.01); *C10M 2201/0413* (2013.01); *C10M 2201/0663* (2013.01); *C10N 2030/06* (2013.01); *C10N 2050/08* (2013.01)

(58) Field of Classification Search

CPC ..... C10M 103/06; C10M 103/02; C10M 177/00; C10M 2201/041; C10M 2201/0413; C10M 2201/066; C10M 2201/0663; C10N 2030/06; C10N 2050/08

See application file for complete search history.

(56) References Cited

U.S. PATENT DOCUMENTS

| | | | |
|---|---|---|---|
| 3,638,308 | A | 2/1972 | Fischbein et al. |
| 3,774,703 | A | 11/1973 | Sanderson |
| 5,462,362 | A | 10/1995 | Yuhta et al. |
| 5,922,418 | A | 7/1999 | Koike et al. |
| 6,273,973 | B1 | 8/2001 | Parayil et al. |
| 2006/0172897 | A1 | 8/2006 | Yamamoto |

(Continued)

FOREIGN PATENT DOCUMENTS

| | | | |
|---|---|---|---|
| CN | 102627993 | A | 8/2012 |
| CN | 106398802 | A * | 2/2017 |

(Continued)

OTHER PUBLICATIONS

Babuska, et al., "Understanding Friction in MoS2: Part 1: Stress, Time and Temperature," 63rd AVS Symposium, SAND2017-5129C, 15 pages (2017).

(Continued)

*Primary Examiner* — Taiwo Oladapo
(74) *Attorney, Agent, or Firm* — Foley & Lardner LLP

(57) ABSTRACT

A low friction wear surface operable at high temperatures and high loads with a coefficient of friction in the superlubric regime including $MoS_2$ and graphene-oxide on the wear surface is provided, and methods of producing the low friction wear surface are also provided. The low friction wear surface remains with a coefficient of friction in the superlubric regime at temperatures in between about 200° C. and 400° C.

20 Claims, 9 Drawing Sheets

(56) References Cited

U.S. PATENT DOCUMENTS

| | | | |
|---|---|---|---|
| 2007/0158609 | A1 | 7/2007 | Hong et al. |
| 2008/0116011 | A1 | 5/2008 | Takahama et al. |
| 2008/0302998 | A1 | 12/2008 | Hong et al. |
| 2009/0033164 | A1 | 2/2009 | Khan |
| 2010/0011826 | A1 | 1/2010 | Buehler et al. |
| 2010/0087346 | A1 | 4/2010 | Giesler et al. |
| 2010/0173134 | A1 | 7/2010 | Khokhlov et al. |
| 2011/0046027 | A1 | 2/2011 | Zhamu et al. |
| 2012/0115761 | A1 | 5/2012 | Basu |
| 2012/0118255 | A1 | 5/2012 | Jung et al. |
| 2012/0122743 | A1 | 5/2012 | Ivanov et al. |
| 2012/0204429 | A1 | 8/2012 | Vlachos et al. |
| 2013/0015409 | A1 | 1/2013 | Fugetsu |
| 2013/0115462 | A1 | 5/2013 | Mazyar et al. |
| 2013/0126865 | A1 | 5/2013 | Chiang et al. |
| 2013/0190449 | A1 | 7/2013 | Kinloch et al. |
| 2013/0324447 | A1 | 12/2013 | Tsou et al. |
| 2014/0291819 | A1 | 10/2014 | Barth |
| 2015/0197701 | A1 | 7/2015 | Sumant et al. |
| 2015/0367381 | A1 | 12/2015 | Sumant et al. |
| 2016/0325994 | A1 | 11/2016 | Qu et al. |
| 2018/0223208 | A1 | 8/2018 | Sumant et al. |
| 2018/0251641 | A1 | 9/2018 | Vasileiou et al. |

FOREIGN PATENT DOCUMENTS

| | | | | |
|---|---|---|---|---|
| CN | 106398802 | A | * | 2/2017 |
| CN | 108251195 | A | * | 7/2018 |
| RU | 2310777 | C2 | | 11/2007 |
| WO | WO-2010/125059 | A1 | | 11/2010 |
| WO | WO-2011/081538 | A1 | | 7/2011 |
| WO | WO-2012/046069 | A1 | | 4/2012 |

OTHER PUBLICATIONS

Berman, et al., "Macroscale superlubricity enabled by graphene nanoscroll formation," Science 348(6239), pp. 1118-1122 (2015).
Hare & Burris, "The Effects of Environmental Water and Oxygen on the Temperature-Dependent Friction of Sputtered Molybdenum Disulfide," Tribology Letters 52(3), pp. 485-493 (2013).
Kimura, et al., "Boron nitride as a lubricant additive," Wear 232(2), pp. 199-206 (1999).
Podgornik, et al., "Tribological behaviour and lubrication performance of hexagonal boron nitride (h-BN) as a replacement for graphite in aluminium forming," Tibology International 81, pp. 267-275 (2015).
Wu, et al., "Experimental analysis of tribological properties of lubricating oils with nanoparticle additives," Wear 262(7-8), pp. 819-825 (2007).
Berman, et al., "Operando tribochemical formation of onion-like-carbon leads to macroscale superlubricity," Nature Communications 9, 1164, 9 pages (2018).
Buckley, "Friction, wear, and lubrication in vacuum," NASA Technical Report No. NASA-SP-277, 190 pages (1971).
Cumings & Zettl, "Low-Friction Nanoscale Linear Bearing Realized from Multiwall Carbon Nanotubes," Science 289(5479), pp. 602-604 (2000).
Dienwiebel, et al., "Superlubricity of Graphite," Physical Review Letters 92(12), 126101, 4 pages (2004).
Fundus & Knock, "Diamond Like Carbon Coatings—Tribological Possibilities and Limitations in Applications on Sintered Silicon Carbide Bearing and Seal Faces," Proceedings of the 14th International Pump Users Symposium, pp. 93-98 (1997).
International Search Report & Written Opinion for PCT/US20013/051121 dated Nov. 14, 2013, 8 pages.
Kim, et al., "Chemical Vapor Deposition-Grown Graphene: The Thinnest Solid Lubricant," ACS Nano 5(6), pp. 5107-5114 (2011).
Kim, et al., "Chemical Vapor Deposition-Grown Graphene: The Thinnest Solid Lubricant," ACS Nano 5, pp. 5107-5114 (2014).
Lee, et al., "Frictional Characteristics of Atomically Thin Sheets," Science 328(5974), pp. 76-80, (2010).
Liu, Z., et al., "Observation of Microscale Superlubricity in Graphite", Physical Review Letters, May 18, 2012, 108:205503-1-205503-5.
Novoselov, et al., "Electric Field Effect in Atomically Thin Carbon Films," Science 306(5696), pp. 666-669 (2004).
Singhbabu, et al., "Efficient anti-corrosive coating of cold-rolled steel in a seawater environment using an oil-based graphene oxide ink," Nanoscale 7(17), pp. 8035-8047 (2015).
Stankovich, et al., "Synthesis of graphene-based nanosheets via chemical reduction of exfoliated graphite oxide," Carbon 45(7), pp. 1558-1565 (2007).
Sumant, et al., "Ultrananocrystalline Diamond Film as a Wear-Resistant and Protective Coating for Mechanical Seal Applications," Tribology Transactions 48(1), pp. 24-31 (2005).
U.S. Notice of Allowance on U.S. Appl. No. 14/415,499 dated Oct. 3, 2017.
Yu, et al., "Graphene segregated on Ni surfaces and transferred to insulators," Applied Physics Letters 93, 113103, 4 pages (2008).
Hamilton, et al., "A Possible Link Between Macroscopic Wear and Temperature Dependent Friction Behaviors of MoS2 Coatings," Tribology Letters 32, pp. 91-98 (2008).
Shojaei & Kang, "Electronic Structure and Carrier Mobility of Two-Dimensional a Arsenic Phosphide," The Journal of Physical Chemistry C 119(34), pp. 20210-20216 (2015).
Singh, et al., "Fatigue resistant carbon coatings for rolling/sliding contacts," Tribology International 98, pp. 172-178 (2016).

* cited by examiner

SUPERLUBRIOUS HIGH TEMPERATURE COATINGS

STATEMENT OF GOVERNMENT INTEREST

This invention was made with government support under Contract No. DE-ACO2-06CH11357 awarded by the United States Department of Energy to UChicago Argonne, LLC, operator of Argonne National Laboratory. The government has certain rights in the invention.

BACKGROUND

Understanding and controlling the root causes of friction have long been a tireless pursuit of mankind mainly because friction impacts our safety, mobility, and environment in so many ways. Accordingly, those scientists who study friction across many scales and engineers who design, manufacture, and operate moving mechanical assemblies ("MMAs"), like motored vehicles, have all aimed at drastically reducing or even totally vanishing friction or achieving superlubricity at engineering scales. The superlubric regime is attractive because it would provide the highest levels of savings in energy, environment, and money. Despite the development and use of many kinds of solid and liquid lubricants in recent years, superlubricity is seldom achieved at macro or engineering scales. Friction coefficients of above 0.01 to 0.1 are considered low friction and above that transitions to high friction. Generally, friction coefficients of less than 0.01 are considered superlow, and hence fall in the superlubric regime. Such levels of friction coefficients are typical of those surfaces that are either aero- or hydro-dynamically separated or magnetically levitated where little or no solid-to-solid contact takes place. Under sliding regimes where direct metal-to-metal contacts prevail and high contact pressures are present, achieving superlubric friction coefficients (i.e., less than 0.01) is difficult due to the concurrent and often very complex physical, chemical, and mechanical interactions taking place at sliding surfaces.

Superlubricity is very difficult to achieve at macro-scale tribological tests and mechanical systems. Sliding mechanical systems at high temperatures and high loads are the ubiquitous in industries such as automobile, heavy machinery, surface and underground drilling, space and extraterrestrial applications. These applications typically experience high loads applied at high temperatures that result in aggravated frictional losses resulting in significant deterioration of overall efficiency of the engine systems. This is because all sliding mechanical systems are prone to wear/tear and their efficiency directly depends on the friction that exists between sliding components. Currently, high temperature greases and limited compositions of synthetic oil-based lubricants are being used in such applications; these not only need replenishment at periodic intervals but also significantly fall short of the expected levels of friction elimination. Replacement of lubricant oils also calls for either partially or completely shutting down operations, which results in further lowering of efficiency and increased man hours for continuous functioning of the mechanical systems.

Multiple reports have thoroughly established and explained superlubricity at room temperature; however, no reports have demonstrated such an effect at high temperatures or high contact pressures and/or as an dynamically adaptive mechanism. Very low friction between linearly sliding surfaces in the order of 0.02-0.06 has been shown but only in inert and ultra-high vacuum ("UHV") environments.

The lubricants themselves are applied via an elaborate chemical or physical deposition technique.

$MoS_2$ composites containing Ti, Au, or $Sb_2O_3$ have shown low friction comparable to the aforementioned values but are developed using elaborate procedures such as magnetron sputtering and/or pulsed laser deposition. $MoS_2$ has been used in low wear solid lubricants widely in aerospace applications due to its ability to have its shear strength decrease with increasing temperature. However, the coefficient of friction ("COF") is limited to about 0.02-0.06 in inert and UHV environments which is not in the range of superlubricity. $MoS_2$ is sensitive to water and oxygen contamination and can rapidly deteriorate with increasing temperatures. The low friction regimes were limited to a high of 200° C., beyond which the lubricants were often observed to render ineffective. The best performance of $MoS_2$ in ambient conditions has been shown to be between about 100° C. and about 250° C. Water vapor deteriorated the coating under 100° C., whereas oxidation deteriorated the coating above 250° C. due to interference and disruption of lamellar shear through physical bonding.

SUMMARY

One embodiment relates to a method of forming a low friction wear surface. The method comprises preparing graphene by chemical exfoliation of highly oriented pyrolytic graphite, suspending the graphene in a solvent to form a solution of at least 1 mg/L, adding at least 1 g/L of $MoS_2$ ultrafine nanocrystalline flakes to the solution, sonicating the $MoS_2$ and the solution to form a homogeneous solution, and disposing the homogenous solution on a substrate. Disposing the homogenous solution includes spraying the homogenous solution on a substrate via a process of air-spray coating, forming a wet film on the substrate, and evaporating the solvent component to form a dry coating layer. The substrate has a temperature at about 275° C., and the graphene-oxide and the $MoS_2$ are in a range of ratios in between $(1\pm0.25):(1\mp0.25)$ by weight.

One embodiment relates to a low friction wear surface. The low friction wear surface comprises a substrate, graphene-oxide in an oil-free solvent disposed over the substrate, and $MoS_2$ ultrafine nanocrystalline flakes disposed over the substrate. The graphene-oxide and the $MoS_2$ are in a range of ratios in between $(1\pm0.25):(1\mp0.25)$ by weight.

One embodiment relates to a method of forming sliding mechanical system on a low friction wear surface. The method comprises forming an oil-free homogenous solution comprising $MoS_2$ and graphene-oxide in a range of ratios in between $(1\pm0.25):(1\mp0.25)$ by weight, disposing the homogenous solution over a substrate to form a first sliding component, and sliding the first sliding component against a second sliding component in open air. Scrolls of $MoS_2$ are formed and encapsulated in the graphene-oxide in this sliding mechanical system.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIG. 3A shows the COF, 0.004±0.002, for the low friction wear surface at 200° C., which remains below the superlubric threshold for three hours with a maximum contact pressure of 1.0 GPa. FIG. 3B shows the COF, 0.005±0.002, for the low friction wear surface at 300° C., which remains below the superlubric threshold for 1.4 hours with a maximum contact pressure of 0.9 GPa. FIG. 3C shows the COF, 0.007±0.002, for the low friction wear surface at 400° C., which remains below the superlubric threshold for 0.4 hours with a maximum contact pressure of 0.5 GPa. FIG. 3D shows comparisons between the coefficients of friction at different temperatures and demonstrates that the low friction wear surface is superlubricous in a temperature range of 200° C. to 400° C. These tests were performed by a multifunctional tribometer.

FIGS. 4A and 4B demonstrate the superlubric region of the low friction wear surface at 200° C. FIGS. 4C and 4D demonstrate the superlubric region of the low friction wear surface at 300° C. FIGS. 4E and 4F demonstrate the superlubric region of the low friction wear surface at 400° C.

FIG. 5A shows the COF at 200° C. FIG. 5B shows the COF at 300° C. FIG. 5C shows the COF at 400° C. These samples were held under similar loading conditions as the samples with the low friction wear surface coating (FIGS. 4A-4F), and the samples without the low friction wear surface coating demonstrate coefficients of friction several orders of magnitude larger than the samples with the coating.

FIG. 6D shows a comparison of a wear track depth between steel on steel wear and a protective tribolayer. The wear resistance was tested at 200° C. under a ramping load profile with a peak load of 5 N.

FIG. 7A is a scanning electron microscope ("SEM") image of a wear track. FIG. 7B is a Raman spectra across the surface of the SEM shown in FIG. 7A.

(FIG. 8A) and the resulting Raman spectra. FIGS. 8B and 8C show the Raman spectra collected at the points shown on FIG. 8A. FIG. 8B shows the Raman spectra from the as-deposited coating and that the coating did not deteriorate. FIG. 8C shows the Raman spectra inside the wear track of just the tribolayer and the retention of graphene-oxide and $MoS_2$ without significant changes.

FIGS. 9A and 9B show the unique processing technique that laminates the $MoS_2$ with graphene-oxide, passivating the $MoS_2$ from ambient oxygen and moisture. FIG. 9B further shows a more detailed image than that of FIG. 9A and that $MoS_2$ forms scrolls that are encapsulated by large blankets of graphene-oxide flakes.

DETAILED DESCRIPTION

Figure 1:
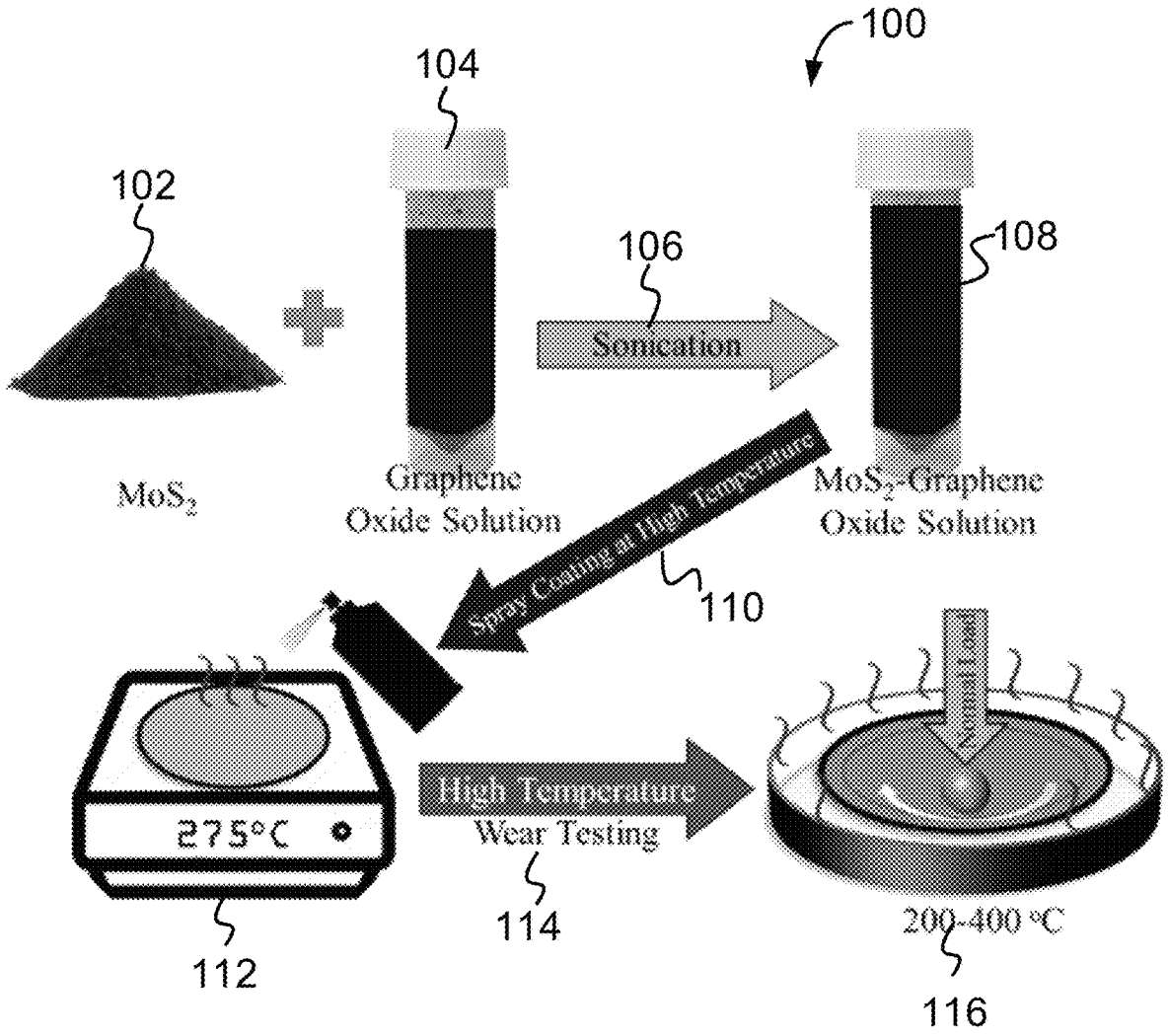
FIG. 1 is a schematic depiction a method of forming a low friction wear surface.

Following below are more detailed descriptions of various concepts related to, and embodiments of, inventive low friction and wear resistant graphene containing surfaces. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Generally speaking, the various embodiments described herein include a low friction wear surface including two-dimensional ("2-D") materials such as, but not limited to, $MoS_2$, graphene-oxide ("GO"), $WS_2$, $MoTe_2$, and graphene. The wear surface may exhibit superlubricity in high temperatures (above 200° C., such as to a maximum of 400° C.) and under high loads (above 0.5 N, such as to a maximum of 9 N). Embodiments described herein may provide several advantages over conventional materials that demonstrate superlubricity, including, for example: (1) providing superlubricity (i.e., less than 0.01 COF) at high temperatures ranging from about 200° C. to about 400° C.; (2) significantly reducing wear, to the point of no measurable wear, at these high temperatures and at high loads with excellent longevity; (3) improving energy efficiency by reducing wear; (4) providing highly uniform surface finishes through a spray-coating application without limiting uniformity to flat surfaces; (5) reducing operational costs; (6) extending the service life of components; and (7) demonstrating the superlubricity and these improved properties without the restriction of a using a diamond like carbon counter face or a dry nitrogen environment as has been required by prior 2-D materials. Realization of superlubricity in sliding systems at high temperatures is extremely important not only from a scientific point of view but also from a technological point of view. It could make a significant positive impact on enhancing efficiency and durability of many rotating mechanical systems such as wind turbines and hence considerable savings on energy.

A low friction wear surface may be produced by any appropriate process. According to one embodiment, the process may include forming a homogenous solution from two 2-D materials. The 2-D materials may be $MoS_2$ and GO. The $MoS_2$ and GO form a homogenous suspension in a range of ratios in between $(1\pm0.25):(1\mp0.25)$, such as but not limited to 8:10 to 10:8, including 10:10. The homogenous suspension is disposed over a substrate heated to within the range of 250° C. to 300° C., such as 275° C. Water is a carrier medium to deposit the homogenous suspension of $MoS_2$ and GO on to the substrate. It is believed that, as perfectly spherical water droplets containing the solid nanomaterials impinge on to the superheated surface, they instantaneously evaporate with a miniature yet high energy explosion akin to cavitation. This transfers the entire solid materials on to the solid substrate as the liquid evaporates. This high activation energy contained in the small water-droplet system forces the solid particles together. Since the two phases ($MoS_2$ and GO) are in equal or near-equal proportions in a homogenous suspension, they eventually form layered structure which is identified as the $MoS_2$ layer-level encapsulation. Specifically, with regard to the lower end-point of the temperature range, the boiling point of the carrier liquid (100° C. in this case), amount of solid phases present (such as 2 g/L), and the droplet size are believed to impact the minimum temperature at which this occurs. Notably, the solid phases in the water drop act as impurities, as well as the impinging jet effectively eliminate Leidenfrost effect. The process may be carried out at atmospheric pressures and temperatures, that is exposed to oxygen (in the atmosphere) and at a temperature of about 20-22° C. contrary to the prior art requiring a dry, inert, or nitrogen environment. The disposing of the homogeneous solution on the substrate may be achieved by any suitable process, such as a spray casting or a solution processed method.

FIG. 1 is a schematic flow diagram of an example method 100 for forming a low friction wear surface including $MoS_2$ and GO. In this method 100, $MoS_2$ may be added to a container (e.g., a vial) at 102. The $MoS_2$ may be in the form of ultrafine nanocrystalline flakes. The size of the $MoS_2$ flakes is 300-500 nm and must should be commensurate or be smaller than the size of the GO flakes. In some embodiments, at least 1 g/L of $MoS_2$ ultrafine nanocrystalline flakes is added. The $MoS_2$ powder can be a nanocrystalline in nature and does not have to be 2-D to begin. It is believed that during the sliding process, exfoliation of $MoS_2$ occurs, forming 2-D layers of $MoS_2$.

A GO solution may be then added to the container at 104. The GO solution has a concentration between 1-15 g/L for forming the lubricant. The GO solution may be obtained by exfoliating graphene and disposing the resulting graphene flakes in a liquid. The graphene may be exfoliated by any appropriate chemical or mechanical exfoliation process, such as chemical exfoliation of highly oriented pyrolytic graphite in the case of graphene. The GO solution may be an aqueous with an oil-free solvent. In some embodiments, the GO will be suspended in water. An oil-free solution is more environmentally friendly, devoid of oil related hazards, and easy to strip after usage. In some embodiments, the coating may be easily removed by immersing the coated substrate into de-ionized water and sonicating for 3 minutes or instantaneously by pressure jet washing. In some embodiments, the GO is suspended in a solvent to form a solution of at least 1 g/L, preferably 5 g/L.

Ultra-low friction is achieved when GO and $MoS_2$ form heterostructures and lower the shear strength of layered 2-D materials with increasing temperature. The shear strength of $MoS_2$ decreases with increasing temperature in itself, but does not achieve superlubricity without the addition of GO. $MoS_2$ alone can produce a friction as low as 0.04 at 100° C. when tested in ambient atmospheric conditions. See Hare & Burris, "The Effects of Environmental Water and Oxygen on the Temperature-Dependent Friction of Sputtered Molybdenum Disulfide," Tribology Letters 52(3), pp. 485-493 (2013). However, increase in temperature beyond 100° C. deteriorated lubricious properties due to rapid intercalation of $MoS_2$ films from oxygen and water, as evidenced by formation of $MoO_3$ compounds. It has been discovered that the addition of GO prevents such deleterious effects and prolongs the life of $MoS_2$ for longer durations. It has been observed that $MoS_2$ reorients the basal planes progressively, with increasing sliding distance and temperature. The signal from the $A_{1g}$ and $A_g'B_{1g}$ rises sharply indicating that this basal plane reorientation contributes to lowering of friction. These morphological changes are permitted by the protective graphene oxide layers that seal $MoS_2$ from oxygen and vapor. In the absence of such a protection, $MoS_2$ would generate rapidly before any reorientation and consequent friction reduction kicks into effect.

The method 100 for forming the low friction wear surface includes sonicating at 106 the mixture of $MoS_2$ and GO in the container to form a homogeneous suspension 108. The solid $MoS_2$ interacts with solid GO sheets in the suspension via van-der-Waals forces. The mixture includes solid graphene-oxide sheets suspended in water to form a solid in an liquid suspension. The reaction does not proceed by nucleation of $MoS_2$/GO from a saturated/supersaturated solution, but rather evaporation of the carrier liquid and deposition of the solid materials onto the hot substrate. The deposition and instantaneous bond formation is aided by the cavitation type explosion as the water droplet impinges on to the surface as discussed previously. Sonication may be done in any device capable of applying sound energy to agitate particles in a sample, for example, but not limited to an ultrasonic bath or an ultrasonic probe. In one embodiment, the thin layers are mixed by sonication, "sonixing." It is believed that physical agitation will not provide the necessary agitation for the materials to mix homogenously. However, the sonixing did not indicate any material modification of the parent phases. For example, the d-spacing of $MoS_2$ and GO have remained same after sonication.

At 110, the 2-D materials may be introduced onto the surface via a process of air spray-coating by spraying a 2-D materials-containing solution (with a solvent such as water) over the substrate and then evaporating the solvent. In one embodiment, the coating can be applied using any technique that produces a mist. The mist droplets must contain the two phases in suspension. Alternatively, any physical deposition techniques wherein a carrier liquid is used to deliver the solid materials and the carrier liquid, but not require a chemical reaction, can evaporate without physically altering/changing/damaging $MoS_2$ and GO can be used. Such deposition differs from those remaining in solution, such as graphene suspended in oil, or those applied chemically. For example, those materials in solution are, obviously, in solution and not bound to the substrate surface (e.g., flowable oil with suspended particles). In contrast, solid materials that have been deposited as by spraying will not be in solution, rather such materials will be controlled by Van der Waals forces to attach the materials to the substrate. Further, there is also a structural difference between such materials and those formed as a solid on the surface of the substrate by chemical vapor deposition, atomic layer deposition, or the like. In such instances, the material is reacted (covalently bonded) with or chemisorbed to the substrate rather than merely held by Van der Waals forces. The thickness is controlled by altering the samples' exposure time to the mist. The pressure/flowrate can also effectively be used to change the amount of soli-bearing liquid carrier impinged on to the surface. The thickness of the coating "required" to produce superlubric properties depends on the test load as would be appreciated in the art. Lower test loads transition into superlubric regime easily, whereas thicker coatings are required at higher loads and for longer sliding distances. Subsequent coats must be applied after the initial layers have completely dried and have adhered to the substrate firmly.

Further, for more than mono layer, the additional layers are also bound, whereas the solution processed materials experience weaker Van der Waals forces, enabling the sloughing of outer layers and the improved lubricity.

In some embodiments, the method 100 of forming the low friction wear surface includes evaporating the solvent component and encapsulating the $MoS_2$ flakes in GO in one step (i.e., by simultaneous evaporation and consequent encapsulation). Encapsulating the $MoS_2$ flakes greatly helps the longevity and lubricity of the low friction wear surface because the flakes are passivated from ambient oxygen and moisture, increasing the temperature range of the $MoS_2$ flakes to above 250° C. The $MoS_2$ flakes are uniformly, fully coated. This is ensured by virtue of the composition (wt %) of the two phases chosen. Also, this coating process is scalable to larger surfaces and is not restricted to flat surfaces. A large scale application of such may be to utilize a scanning spray nozzle to cover a large area with the graphene in solution and then vaporize the solvent. The surface is required to have some anchoring elements. In one embodiment, a rough surface of at least (Ra~0.2-0.4) provides sufficient anchoring points. In case of extremely smooth substrates, the surfaces would be treated to make them amenable to the deposition techniques. Examples of such treatments include, but are not limited to, ozone treatment and doping with binders that make bonds between the steel and the initial layers and higher substrates (up to 400° C.) temperatures.

At 112, the substrate may be heated, for example to 275° C. In some embodiments, the substrate may be a steel surface, such as but not limited to self-mated hardened stainless steel, ferritic stainless steel, austenitic stainless steel, martensitic stainless steel, duplex stainless steel, and precipitation hardened stainless steel. In some embodiments, the substrate can comprise of at least a portion of a metal working die, a wind turbine, a polymer injection molding die, a piston, a piston ring, a piston sleeve, a ball and roller bearing element, an oil-free air compressor, a gas compressor, a gas seal, a sliding rail guide, or a heavy load bearing wheel guide.

In some embodiments, the low friction wear surface may undergo subjecting the wear surface on the substrate for high temperature wear testing at 114. The method 100 includes heating the temperature to about 200° C. to about 400° C. Normal loads may be applied to the low friction wear surface on the substrate at these high temperatures at 116.

Superlubricity may be defined as a regime of motion in which friction vanishes or nearly vanishes, such as a COF of less than about 0.01. The superlubric friction is measured by sliding the low friction wear surface using a ball-on-disc configuration of wear testing, under unidirectional sliding. The low friction wear surface may be applied on to heated steel samples and immediately tested at high temperatures (e.g., 200° C., 300° C., and 400° C.) or lower temperatures (e.g., 22° C. and 100° C.). The coated substrates were evaluated for wear-friction evaluation in a high temperature tribometer with loads from about 0.5 N to about 8 N and a rotating speed from about 50 rpm to about 300 rpm.

Methods.

Preparation of a Low Friction Wear Surface.

Solution-processed molybdenum disulfide was prepared by chemical exfoliation of bulk $MoS_2$ crystal and was then suspended in ethanol with 18 mg/L graphene. The resulting solution contained 1 to 8 monolayers thick $MoS_2$ flakes. The GO solution may be obtained by exfoliating graphene and disposing the resulting graphene flakes in a liquid. The graphene may be exfoliated by any appropriate chemical or mechanical exfoliation process, such as chemical exfoliation of highly oriented pyrolytic graphite in the case of graphene. The GO solution is suspended in an oil-free solvent to form a solution of at least 1 g/L.

The $MoS_2$ flakes and the GO solution are prepared in different concentrations are then mixed together and then sonicated using an ultrasonic bath for 2-15 minutes at 20-125 kHz frequency. The now homogenous solution is then sprayed or drop casted (100-10,000 nm in diameter) on a self-mated stainless steel substrate heated to about 275° C. This process results in a uniformly distributed coating on the substrate surface. The expected area of 2-D $MoS_2$ flakes per unit area of the substrate is in the range of 175-800 $cm^2$ per $mm^2$ of substrate.

In the ball-on-disc tests, the counterpart may be a stainless steel ball (440 C grade) of 3-10 mm diameter.

Tribometer Testing.

Tribological tests were performed in ambient environmental conditions at temperatures ranging from about 22° C. to about 450° C. using a CSM ball-on-disk macroscale tribometer. The normal load during the tribotests was kept at with loads from about 0.5 N to about 8 N and a rotating speed from about 50 rpm to about 300 rpm (where the radius of the wear track varied from 1 mm up to 15 mm). Zero calibration of the machine was performed automatically at the beginning of each test. All the tests were repeated at least 5 times at each temperature to confirm reproducibility of the results.

The wear volume of the flat was very difficult to assess, as wear was manifested as deep scratches and could not be fit into a reliable wear equation. To estimate the wear volume for the balls after the tribotests, we used the following equation:

$$V = \left(\frac{\pi h}{6}\right)\left(\frac{3d^2}{4} + h^2\right)$$

where $$h = r - \sqrt{r^2 - \frac{d^2}{4}},$$

d is wear scar diameter, and r is the radius of the ball.

Figure 2A:
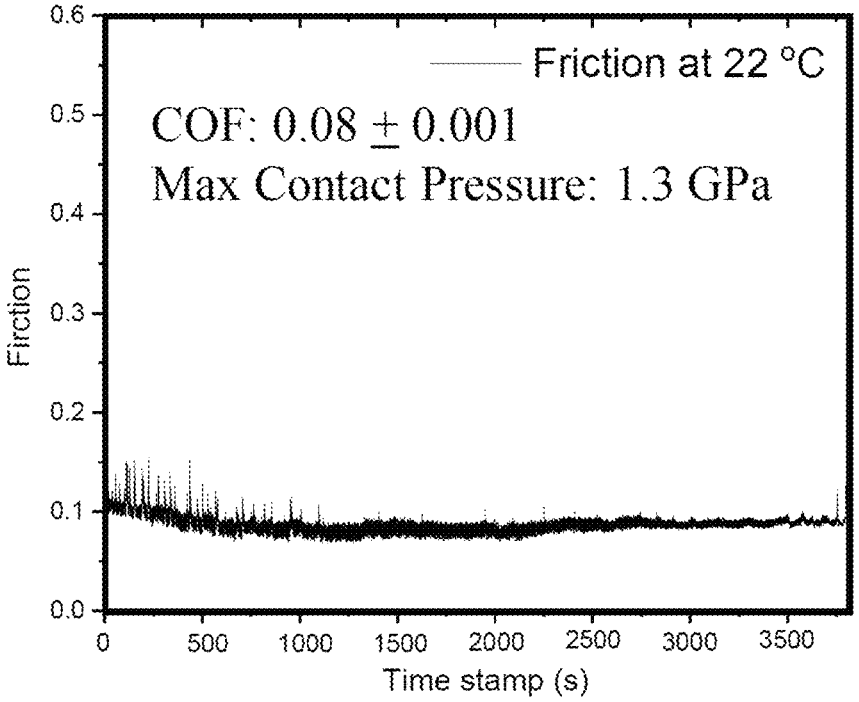
FIGS. 2A and 2B are frictograms depicting a COF for a length of time under ambient environmental conditions (room temperature, atmosphere exposure) of a low friction wear surface at 22° C. and 100° C., respectively.
Figure 2B:
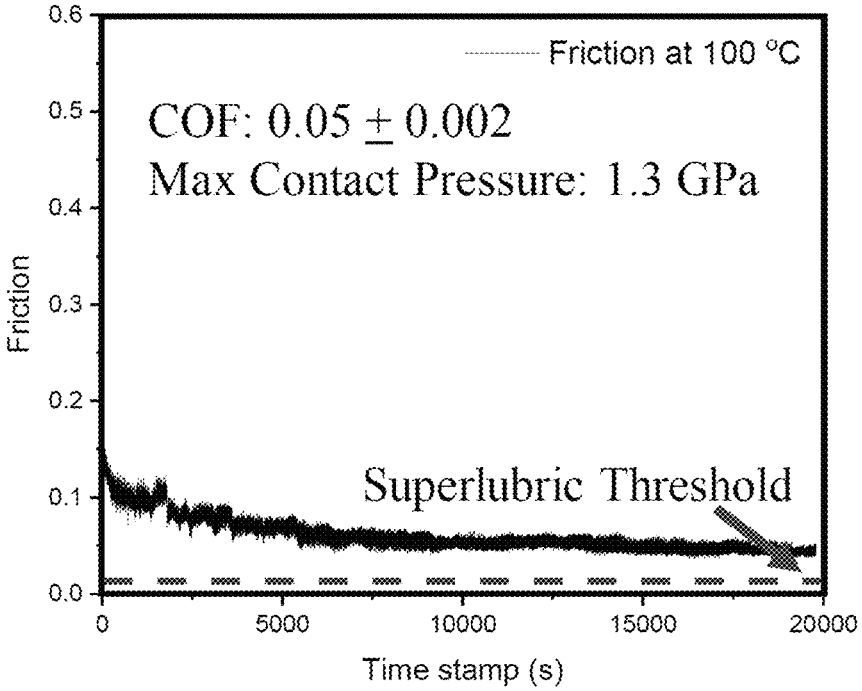

As shown in FIGS. 2A and 2B, low friction values for a low friction wear surface comprised of $MoS_2$ and GO, formed from a method of any of the previous embodiments discussed, are observed at both 22° C. and 100° C. under ambient environmental conditions (room temperature, atmospheric exposure). Also, it is determined that although the COF does not reach the superlubric threshold at these temperatures, the COF decreases with increasing temperature and still display values lower than 0.1, under a contact pressure of 1.3 GPa.

Figure 3A:
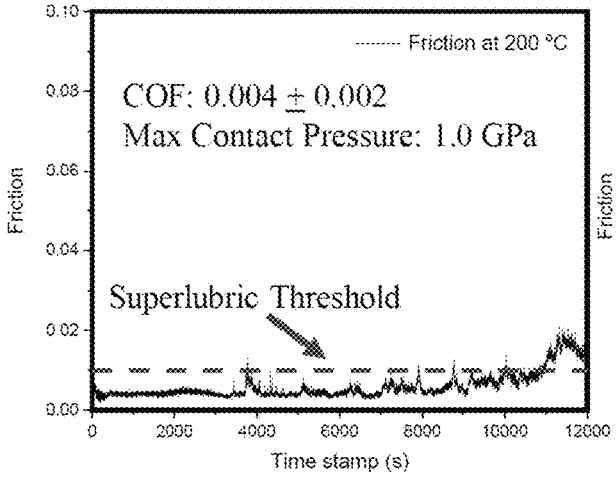
FIGS. 3A-3D are frictograms depicting a COF for a length of a time of a low friction wear surface at 200° C., 300° C., and 400° C.
Figure 3B:
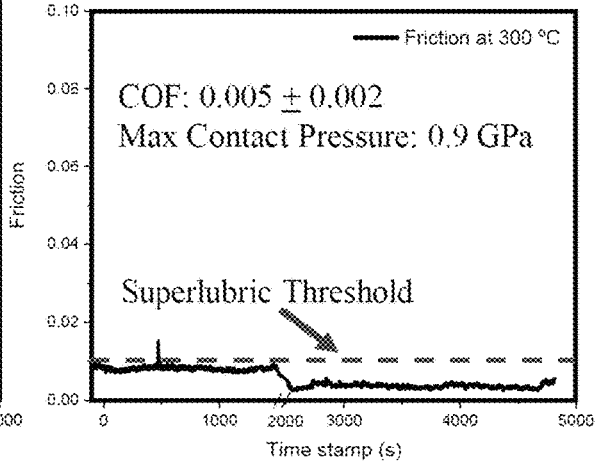
Figure 3C:
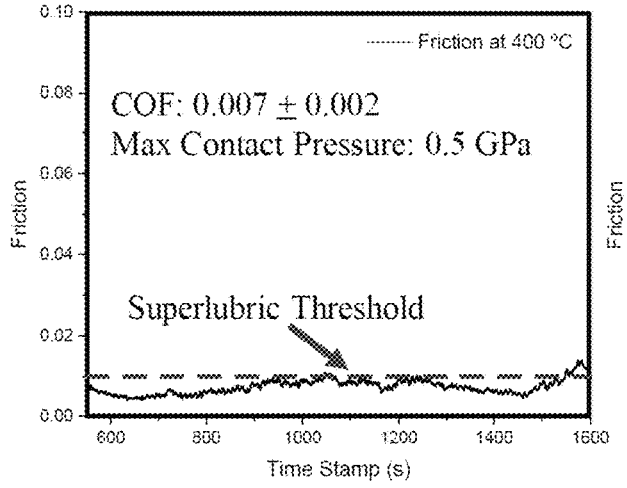
Figure 3D:
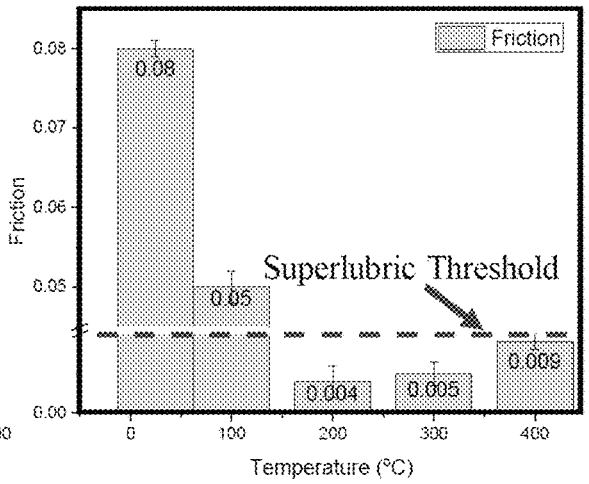

As shown in FIGS. 3A-3D, superlubricity is demonstrated by a low-friction wear surface formed from the method previously described herein at temperatures ranging from about 200° C. to about 400° C. These figures also demonstrate exceptional coating longevity: three hours at 200° C. (FIG. 3A), 1.4 hours at 300° C. (FIG. 3B), and 0.4 hours at 400° C. (FIG. 3C). The coatings also sustain maximum contact pressures from 0.5 GPa to 1.0 GPa, which are all much higher than the yield strength of steel.

As shown in FIGS. 4A-4F, initially, the tribosystem shows a very low friction value which further diminishes to superlubricity under dynamic load from temperatures ranging from about 200° C. to about 400° C. The tribopair remained in the superlubric regime for 67 minutes at 200° C., 100 minutes at 300° C., and 17 minutes at 400° C. with a coating thickness of a few hundred nanometers.

Figure 4A:
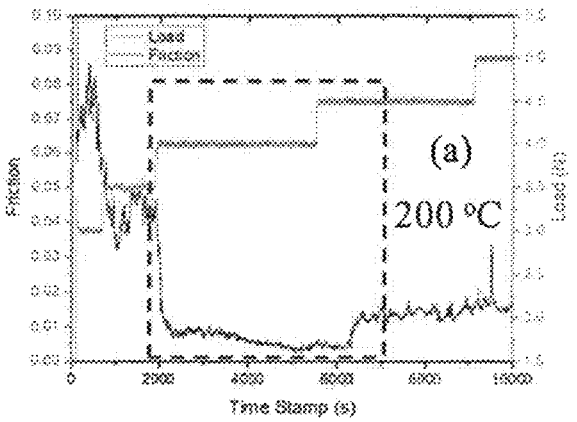
FIGS. 4A-4F are frictograms from 200° C. to 400° C. depicting the COF and the load applied and magnified to show the superlubric region of a low friction wear surface.
Figure 4B:
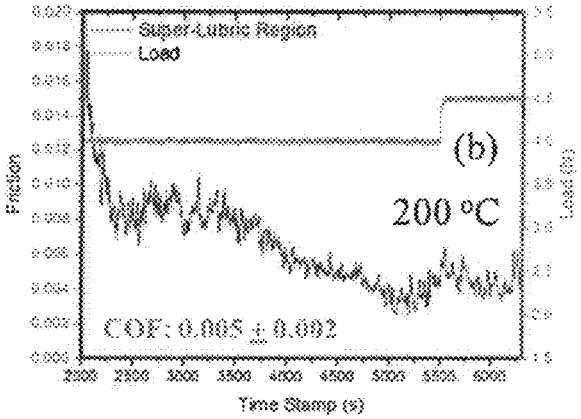
Figure 4C:
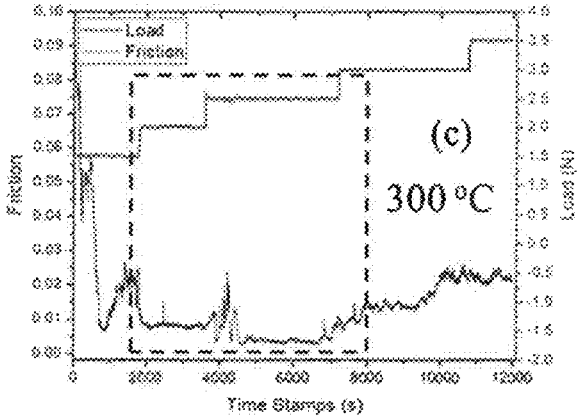
Figure 4D:
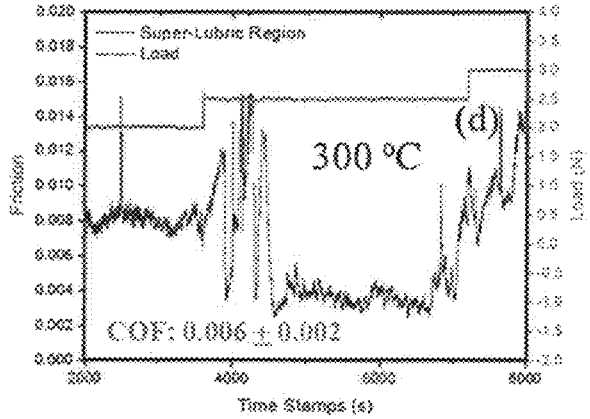
Figure 4E:
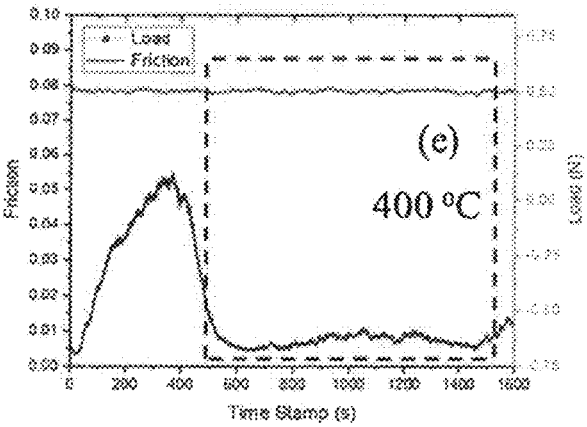
Figure 4F:
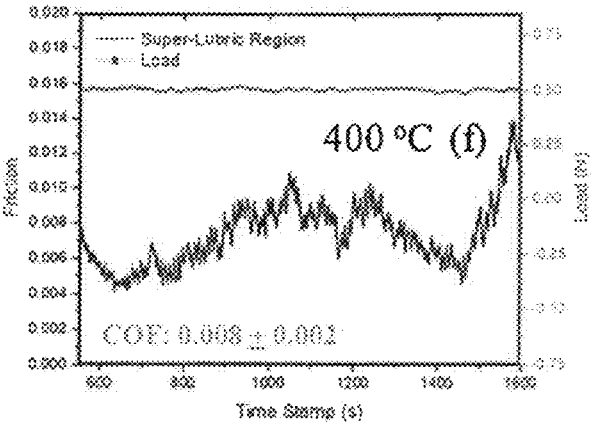
Figure 5A:
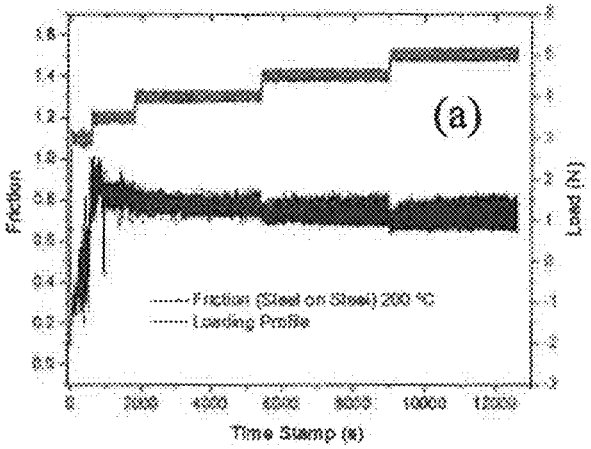
FIGS. 5A-5C are frictograms from 200° C. to 400° C. depicting the COF and the load applied of steel-on-steel surfaces without a low friction wear surface coating.
Figure 5B:
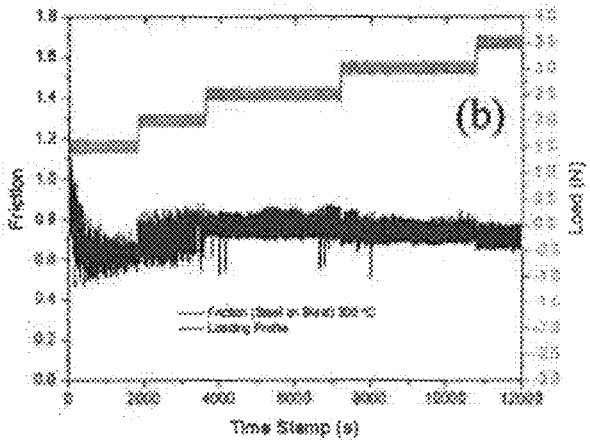
Figure 5C:
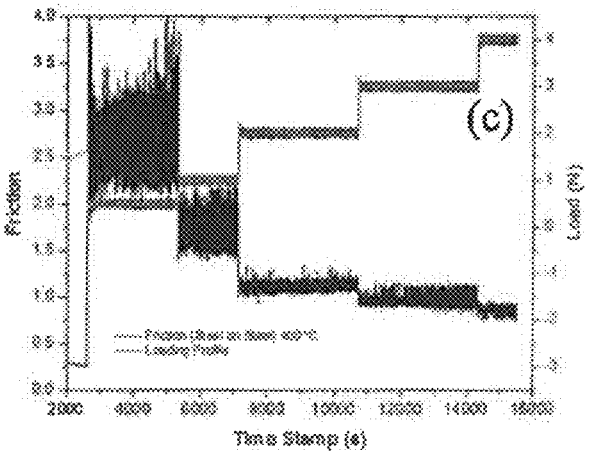

In comparison to the aforementioned friction values from FIGS. 4A-4F, FIGS. 5A-5C shows bare steel-on-steel tests without a coating of the low friction wear surface. The bare steel-on-steel tests were subject to similar loads and run at 200° C. (FIG. 4A), 300° C. (FIG. 4B), and 400° C. (FIG. 4C). At each temperature, the friction on the bare tests were several of orders magnitude larger than that of the steel tests with the low friction wear surface coating. Without the coating, the COF values ranged from about 0.2 to about 4.0, which is substantially larger than the COF of the steel with the coating, even at room temperature.

Figure 6A:
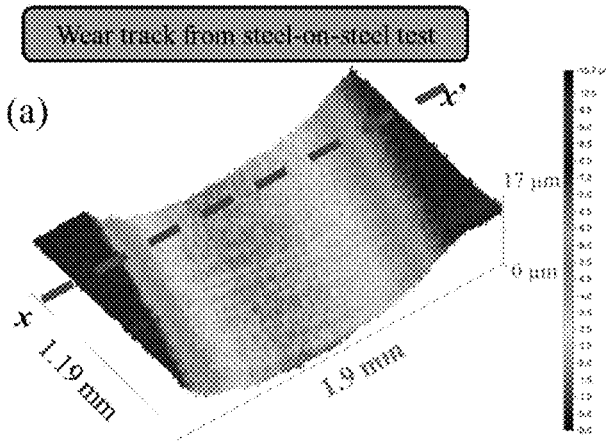
FIGS. 6A-6D compare wear resistance on surfaces without a low friction wear surface coating (FIG. 6A), surfaces with the low friction wear surface coating (FIG. 6B), and surfaces after the removal of the low friction wear surface coating (FIG. 6C).
Figure 6B:
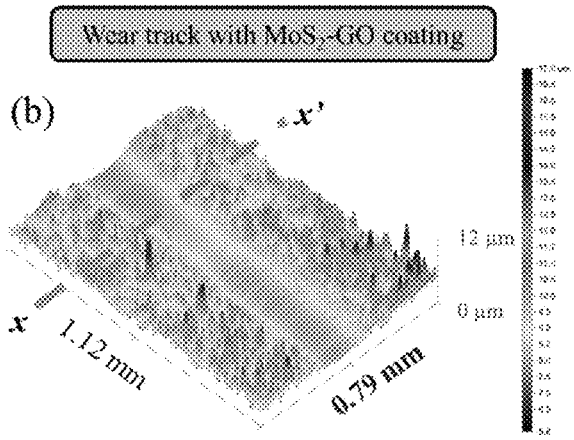
Figure 6C:
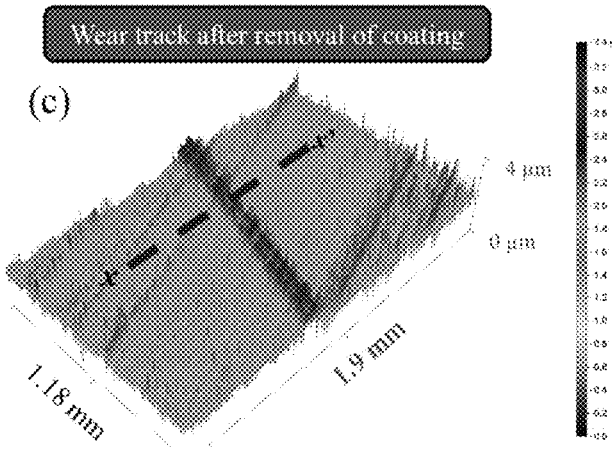
Figure 6D:
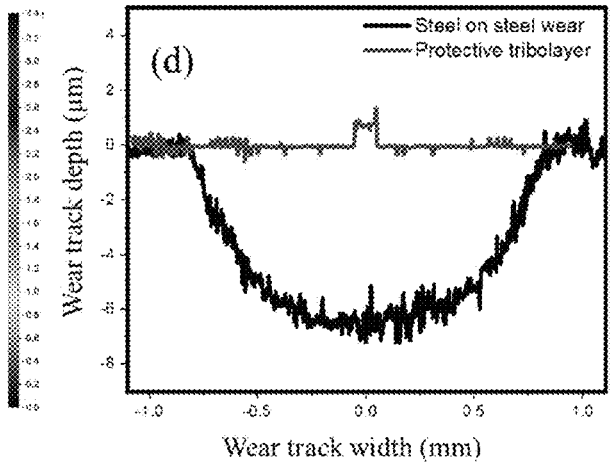

The wear on a steel surface in comparison to a steel surface with the low friction wear surface coating is further demonstrated in FIGS. 6A-6D. When tested on a self-mated SS440C tribopair, the wear volume loss on the tribopair (FIG. 6A) was 77 times more than that of the self-mated SS440C with the low friction wear surface coating (FIG. 6B).

Characterization Techniques.

The wear scars were imaged with an Olympus UC30 microscope and characterized by an Invia Confocal Raman microscope using the red laser light ($\lambda$=514 nm). The wear debris formed during the tribotests was imaged with a JEOL JEM-2100F transmission electron microscope ("TEM"), for which samples were picked up from the wear track with a probe and transferred to a copper grid. SEM images were imaged with FEI Quanta Scanning Electron Microscope. To gain further insight into the evolution of the carbon-based tribolayer within the wear track and identify the chemical state of the $MoS_2$, Raman spectroscopy studies were carried out.

Figure 7A:
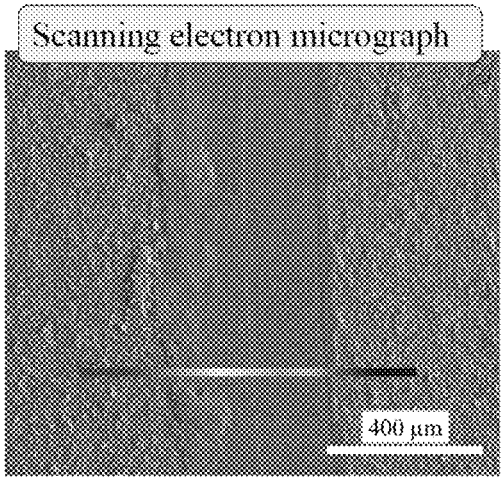
FIGS. 7A-7B show the coating integrity of a low friction wear surface.
Figure 7B:
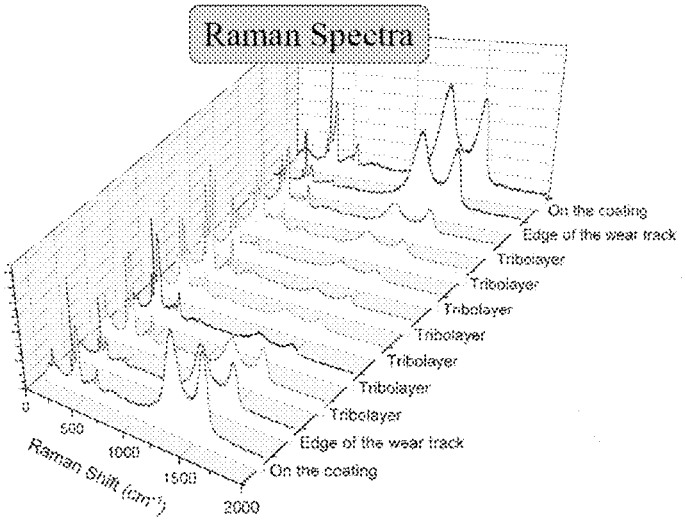
Figure 8A:
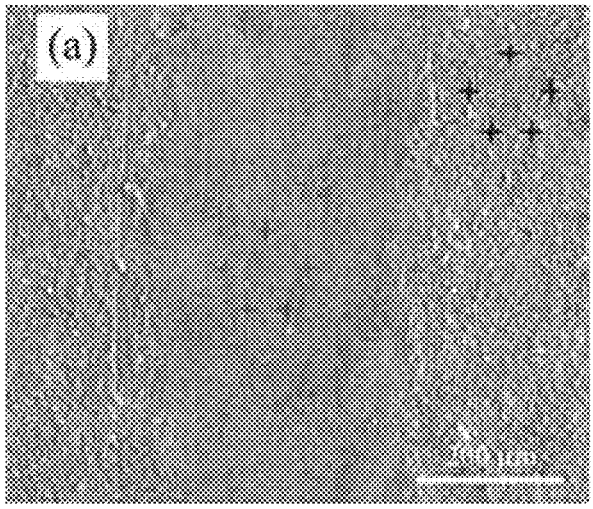
FIGS. 8A-8C show a SEM image of a wear track at a temperature of 300° C.
Figure 8B:
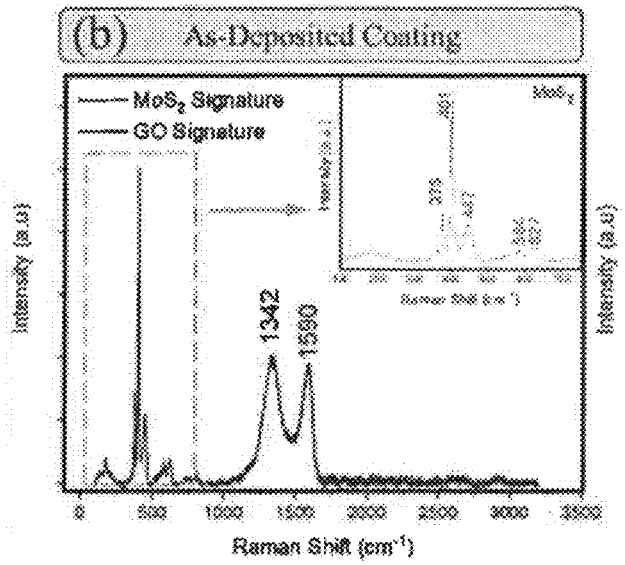
Figure 8C:
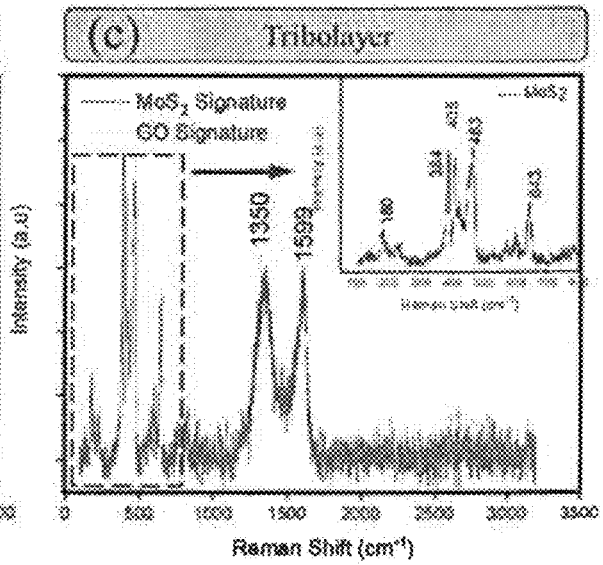

The longevity of a low friction wear surface is further demonstrated in FIGS. 7A-7B and FIGS. 8A-8C. As shown in FIGS. 7A and 7B, the Raman 2-D mapping of the characteristic peaks shows gradual yet distinct changes in tribochemistry and demonstrates a high degree of coating integrity. Similarly, FIGS. 8A-8C demonstrate the integrity of the sample and the wear track. FIG. 8B demonstrates Raman spectra acquired from the as-deposited coating whereas that from inside the wear track is presented in FIG. 8C. The Raman peak positions remain unchanged indicating that the coating did not deteriorate during the test.

Figure 9A:
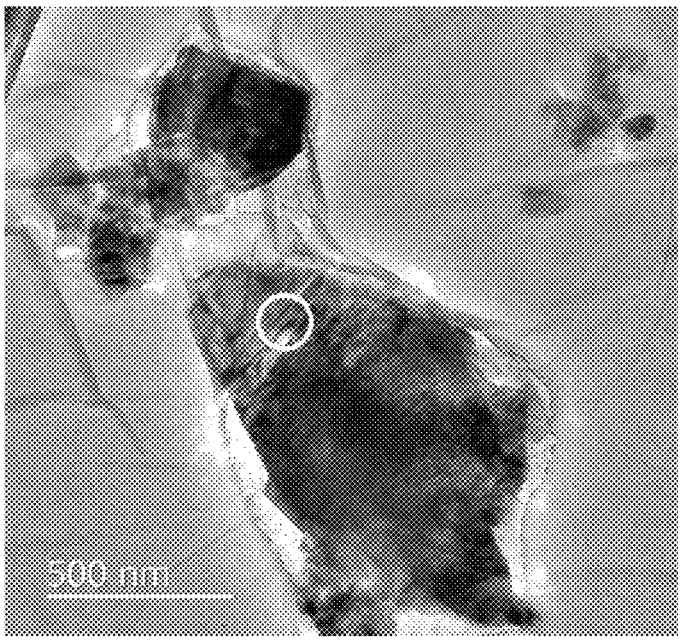
FIGS. 9A and 9B show TEM images with scale bars of 500 nm and 100 nm, respectively.
Figure 9B:
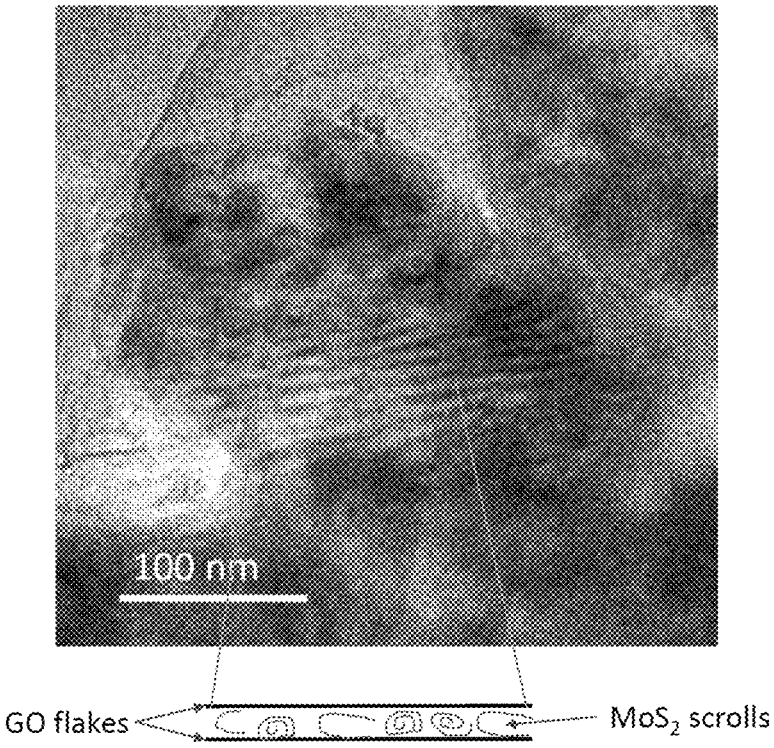

TEM analysis from FIGS. 9A-9B of the low friction wear product demonstrates the lamination (i.e. the coating process via the one-step process described above of the $MoS_2$ flakes with GO. The flakes are encapsulated by large blankets of GO in order to passivate the $MoS_2$ from the ambient oxygen and moisture. This further shows in the TEM image from FIG. 9B that scrolls of $MoS_2$ form. The concentration of scrolls formed results in a superlubric behavior.

It is believed that the reason for superlubricity is related to maintaining the inert layered structure of $MoS_2$ by encapsulation of GO flakes. The layered structure may be scrolls, but must encapsulate the 2-D material, such as $MoS_2$. It is believed that during sliding at high contact pressures at high sliding velocity and elevated substrate temperatures, structural re-orientation of $MoS_2$ takes place resulting in layered structure as shown in FIG. 9B. This layered structure is preserved for longer time from oxygen induced degradation due to conformal encapsulation provided by large GO sheets as shown in FIGS. 9A-9B, thus lowering the friction to superlubric regime (below 0.01) and maintaining it for longer time duration.

In summary, a low friction wear surface includes a substrate, GO in an oil-free solvent disposed over the substrate, and $MoS_2$ ultrafine nanocrystalline flakes disposed over the substrate. The GO and the $MoS_2$ are in a range of ratios of $(1\pm0.25):(1\mp0.25)$ by weight, respectively. In order to form this low friction wear surface, the substrate has a temperature of about 275° C. when the GO and the $MoS_2$ are disposed on its surface. In some embodiments, the solvent mixed with GO is water.

As shown in the figures and descriptions above, the low friction wear surface displays a much lower COF than a surface without the low friction wear surface. In some embodiments, the low friction wear surface has a COF value less than 0.06 at a temperature in between about 200° C. and 400° C. for a duration of about 15 minutes to about 3.5 hours, inclusive. In some embodiments, the low friction wear surface has a maximum contact pressure in between about 0.1 GPa and about 1.0 GPa at a temperature in between about 200° C. and about 400° C. In some embodiments, the low friction wear surface has a COF less than 0.1 at a temperature in between about 22° C. and about 100° C. in ambient conditions.

In some embodiments, the substrate of the low friction wear surface is made of at least a portion of a metal working die, a wind turbine, a polymer injection molding die, a piston, a piston ring, a piston sleeve, a ball and roller-bearing element, an oil-free air compressor, a gas compressor, a gas seal, a sliding rail guide, or a heavy load bearing wheel guide. In some embodiments, the substrate of the low friction wear surface is a steel, for example but not limited to, a self-mated stainless steel, ferritic stainless steel, austenitic stainless steel, martensitic stainless steel, duplex stainless steel, or precipitation hardened stainless steel.

Furthermore, a method of a forming a low friction wear surface includes preparing graphene by chemical exfoliation of highly-oriented pyrolytic graphite, suspending GO in a solvent to form a solution of at least 1 g/L, adding at least 1 g/L of $MoS_2$ ultrafine nanocrystalline flakes to the solution, sonicating the $MoS_2$ and the solution to form a homogenous solution and disposing the homogenous solution on a substrate. The method of disposing the homogenous solution includes spraying the homogeneous solution on a substrate via a process of air-spray coating, wherein the substrate has a temperature of 275° C.; forming a wet film on the substrate; and evaporating the solvent component to form a dry coating layer. The GO and the $MoS_2$ are in a range of ratios in between $(1\pm0.25):(1\mp0.25)$ by weight, respectively. The solvent in this method may be water, or the solvent may be oil-free. In some embodiments, the method further comprises evaporating the solvent component and encapsulating the $MoS_2$ flakes in large blankets of GO in one step.

In some embodiments, the method of forming the low friction wear surface includes achieving a COF value in between about 0.001 and about 0.06 at a temperature in between about 200° C. and about 400° C. In some embodiments, this method includes demonstrating a COF value less than 0.05 for a duration of about 15 minutes to about 3.4 hours in between about 200° C. and 400° C. In some embodiments, the substrate is a steel material. In some embodiments, the method further includes a COF value less than 0.1 at a temperature in between about 22° C. and about 100° C. in ambient conditions.

A method of forming a sliding mechanical system with a low friction wear surface includes forming a homogeneous solution of $MoS_2$ and GO in a range of ratios in between $(1\pm0.25):(1\mp0.25)$ by weight, disposing the homogeneous solution over a substrate to form a first sliding component, and sliding the first sliding component against a second sliding component in open air. Scrolls of $MoS_2$ are formed and encapsulated in the GO. In some embodiments, the second sliding component may be a steel material. In some embodiments, the method may further include sliding the first sliding component and the second sliding component at a temperature in between about 200° C. and about 400° C. In some embodiments, the solution uses an oil-free solvent. In some embodiments, the homogeneous solution is disposed over the substrate via a method of air spray coating when the substrate is heated to a temperature of about 275° C.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." Any ranges cited herein are inclusive.

The terms "substantially" and "about" used throughout this Specification are used to describe and account for small fluctuations. For example, they may refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" may refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. A method of forming a low friction wear surface comprising:

suspending graphene-oxide in a solvent to form a solution of at least 1 g/L;

adding at least 1 g/L of $MoS_2$ ultrafine nanocrystalline flakes to the solution;

sonicating the $MoS_2$ and the solution to form a homogenous solution; and disposing the homogeneous solution by:

spraying the homogeneous solution on a substrate via a process of air-spray coating, wherein the substrate has a temperature at about 275° C.;

forming a wet film on the substrate; and evaporating the solvent component to form a dry coating layer;

wherein the graphene oxide and the $MoS_2$ are in a range of ratios of 8:10 to 10:8 by weight.

2. The method of claim 1, wherein the solvent component is water.

3. The method of claim 1, wherein the solvent component is oil-free.

4. The method of claim 1, further comprising evaporating the solvent component and encapsulating the $MoS_2$ flakes in large blankets of graphene-oxide in one step.

5. The method of claim 1, further comprising achieving a coefficient of friction value in between about 0.001 and about 0.06 at a temperature in between about 200° C. and about 400° C.

6. The method of claim 5, further comprising demonstrating a coefficient of friction value less than 0.06 for a duration of about 15 minutes to about 3.4 hours, inclusive at a temperature in between about 200° C. and about 400° C.

7. The method of claim 1, wherein the substrate comprises a steel material.

8. The method of claim 1, further comprising achieving a coefficient of friction value less than 0.1 at a temperature in between about 22° C. and about 100° C. in ambient conditions.

9. A low friction wear surface comprising:

a substrate;

graphene-oxide in an oil-free solvent disposed over the substrate; and $MoS_2$ ultrafine nanocrystalline flakes disposed over the substrate;

wherein the graphene-oxide and the $MoS_2$ are in a range of ratios of $(1\pm0.25):(1\mp0.25)$ by weight, respectively.

10. The low friction wear surface of claim 9, wherein the graphene-oxide and the $MoS_2$ are disposed on a substrate heated to about 275° C.

11. The low friction wear surface of claim 9, wherein the solvent is water.

12. The low friction wear surface of claim 9, further comprising a coefficient of friction value less than 0.06 for a duration of about 15 minutes to about 3.5 hours, inclusive, at a temperature in between about 200° C. and about 400° C.

13. The low friction wear surface of claim 9, further comprising a maximum contact pressure in between about 0.1 GPa and 1.0 GPa at a temperature in between about 200° C. and about 400° C.

14. The low friction wear surface of claim 9, further comprising a coefficient of friction value less than 0.1 at a temperature in between about 22° C. and about 100° C. in ambient conditions.

15. The low friction wear surface of claim 9, wherein the substrate comprises at least a portion of a metal working die, a wind turbine, a polymer injection molding die, a piston, a piston ring, a piston sleeve, a ball and roller bearing element, an oil-free air compressor, a gas compressor, a gas seal, a sliding rail guide, or a heavy load bearing wheel guide.

16. A method of forming a sliding mechanical system with a low friction wear surface comprising:

forming a homogeneous solution comprising $MoS_2$ and graphene-oxide in a range of ratios in between 0.75:1.25 and 1.25:0.75;

disposing over a substrate, the homogeneous solution to form a first sliding component; and sliding the first sliding component against a second sliding component in ambient air;

wherein scrolls of $MoS_2$ are formed and encapsulated in the graphene-oxide.

17. The method of claim 16, wherein the second sliding component comprises a steel material.

18. The method of claim 16, further comprising sliding the first sliding component and the second sliding component at a temperature in between about 200° C. and about 400° C.

19. The method of claim 16, wherein disposing the solution over the substrate comprises a method of air-spray coating, wherein the substrate has a temperature at about 275° C.

20. The method of claim 16, wherein the homogenous solution comprises an oil-free solvent.

* * * * *